United States Patent [19]

Kambic

[11] Patent Number: 4,679,416

[45] Date of Patent: Jul. 14, 1987

[54] TRIGGER AND LATCH BOLT ASSEMBLY

[75] Inventor: Raymond V. Kambic, Joliet, Ill.

[73] Assignee: R. R. Brink Locking Systems, Inc., Plainfield, Ill.

[21] Appl. No.: 637,914

[22] Filed: Aug. 6, 1984

[51] Int. Cl.[4] ..... E05B 55/00

[52] U.S. Cl. ..... 70/143; 70/157; 70/480; 292/169.13; 292/169.17; 292/191

[58] Field of Search ..... 70/143, 157, 473, DIG. 42, 70/480; 292/169.13, 169.15, 191, 333, 335, DIG. 62, 169.14, 169.17, 173

[56] References Cited

U.S. PATENT DOCUMENTS

| | | | |
|---|---|---|---|
| 812,871 | 2/1906 | Papenfoth | 292/169.13 |
| 915,536 | 3/1909 | Baker | 292/169.13 X |
| 1,272,915 | 7/1918 | Cleaver | 292/150 X |
| 1,393,911 | 10/1921 | Schumaker | 292/169.15 X |
| 1,514,528 | 11/1924 | Hurd | 292/146 X |
| 1,706,486 | 3/1929 | Gasey | 292/169.15 X |
| 2,107,300 | 2/1938 | Kilpatrick | 70/418 |
| 2,533,023 | 12/1950 | Lickteig | 292/169.15 |
| 2,648,560 | 8/1953 | Quigley et al. | 292/169.13 |
| 2,661,972 | 12/1953 | Schlage | 292/169.13 X |
| 3,999,411 | 12/1976 | Kambic | 70/144 |
| 4,237,711 | 12/1980 | Kambic | 70/150 |

FOREIGN PATENT DOCUMENTS

| | | | |
|---|---|---|---|
| 596418 | 3/1978 | Switzerland | 292/191 |

*Primary Examiner*—Gary L. Smith
*Assistant Examiner*—Lloyd A. Gall
*Attorney, Agent, or Firm*—Trexler, Bushnell, Giangiorgi & Blackstone, Ltd.

[57] ABSTRACT

A lock mechanism includes a casing structure adapted to be mounted to one of a door and a door frame for cooperation with an apertured strike plate mounted to the other of the door and door frame. The lock mechanism further comprises a front plate for the casing structure with a pair of apertures therein and a latch bolt retractably mounted with respect to the casing structure and biased to an extended first position wherein a latching portion thereof extends from one of the front plate apertures for engagement with the strike plate aperture, and movable to a secnd retracted position. The latching portion of the latch bolt has a beveled leading surface located for engagement with the strike plate only when the latch bolt is moved a predetermined amount toward the retracted position. Retracting structure is operatively coupled with the latch bolt for effecting the predetermined amount of movement of the latch bolt toward said retracted position for effecting the desired positioning of the beveled leading surface thereof.

23 Claims, 6 Drawing Figures

TRIGGER AND LATCH BOLT ASSEMBLY

BACKGROUND OF THE INVENTION

The present invention relates to a novel lock assembly for mounting to a door or an associated door frame, preferably of the type wherein the door will control access to a secured area. More particularly, the invention relates to a novel lock assembly including an elongated latch bolt member for added security, without requiring an additional width or thickness dimension of the latch bolt, of the door, the lock casing, or of the associated door frame.

There are many instances where it is desirable to control access to a secured area by means of a lock mechanism used on the door leading to the area. For example, modern penal institutions of the medium to high security type employ specialized security lock apparatus, often including monitoring and remote control apparatus for cell doors. This is done to provide security for the guards as well as for individual inmates. In this regard, it is necessary to control door operations so as to control the ingress and egress of individual inmates at all times, as well as to prevent possible tampering with and/or breakage of the locking assemblies.

The lock assembly of the invention is adapted for use in a swinging-type door installation. The lock assembly is carried in a casing mountable to one of the door and the door frame, the casing being provided with a face plate. Generally speaking, the face plate and casing may be provided with various tamper proof features for preventing the removal of the lock assembly from the door or door frame other than with specialized tools or the like. The lock assembly for such an installation also includes a latch bolt normally spring biased or otherwise movably biased to extend a portion thereof externally of the face plate for engagement with a strike plate on the associated door or door frame. This strike plate carries a centrally located strike aperture for receiving the extended latch bolt portion therein to achieve locking or latching of the door. However, to reach this locked or latched condition, the latch bolt must first retract to pass the portion of the strike plate surrounding the strike aperture. To this end, this outwardly extending or latching portion of the latch bolt is generally provided with a beveled surface to engage the leading edge surface of the strike plate as the door swings to a closed position so as to effect retraction of the latch bolt against the spring biasing thereof. The beveled surface of the latch bolt is formed at substantially a 45-degree angle so as to provide the force component applied to retract the latch bolt during the foregoing closing procedure.

The maximum thickness dimension of a latch bolt having a 45-degree bevel has heretofore been the same dimension as its "throw", that is, the length dimension of its latching portion. This is necessary to assure that the beveled surface will engage the strike plate during closing. That is, if a latch bolt is provided having a latching portion of greater length than thickness, there will be some portion of the surface thereof to which the 45-degree bevel, which it will be understood begins at the outermost edge or tip of the latching portion, will not extend. Hence, with such an elongated latch bolt it is likely that this non-beveled or substantially flat surface would strike the strike plate, failing to retract the latch bolt and properly close the door. Such engagement might also cause some damage or deformation to the latch bolt, strike plate, or to other internal parts of the locking assembly, or even to the door or door frame.

Notwithstanding the foregoing, in a security installation it is often desirable to provide for some increased length of the throw or the latching portion of the latch bolt. It will be recognized that providing a somewhat longer latch bolt throw adds to the security of the latched or locked door assembly as just described. For example, attempts at tampering with the door or otherwise forcing the door or lock open may be countered by providing some additional length to the latching portion of the latch bolt member. This additional length disposes the beveled portion of the bolt more deeply interiorly of the strike aperture, and makes it difficult for an individual to engage the beveled portion with a tool or pry bar. As previously indicated, such additional length normally requires corresponding additional thickness. However, the additional thickness dimension of the latching portion required to accommodate a 45-degree bevel with an increase in length is not simple to provide in most instances.

In this regard, it is important in security installations to maintain as great a thickness as possible of the door or door frame material holding the strike plate, and especially about the strike plate aperture thereof. This is done to make attempts at tampering with, breaking or otherwise overriding the lock by releasing the latch from the strike plate more difficult. Most installations utilize a one and three-quarter inch thick door. Accordingly, a corresponding width dimension is provided in the portion of the door frame between the jamb and outer edge in cases where the strike plate is mounted in the door frame. In any case, it will be noted that a three-quarter inch wide latch bolt will require a corresponding width of strike aperture, thus leaving one-half inch of material to either side thereof when the strike plate is mounted in the door and a corresponding one-half inch thickness of material to the outside edge of the strike aperture when the strike plate is mounted to the door frame.

Hence, extension of the latching portion of the latch bolt to a length of one inch, while maintaining a 45-degree bevel thereon as described above, would require a one-inch width thereof and hence of the cooperating strike aperture. It will be recognized that this requirement would remove at least one-eighth of an inch of thickness from the material of the door to either side thereof when the strike plate is mounted to the door, or to the outside of the aperture wherein the strike plate is mounted to the door frame. Such reductions of thickness of the material of the door to either side of the strike plate aperture or of the material of the door frame to the outside of the aperture are believed to weaken the installation undesirably in a critical area thereof.

Nonetheless, additional length of the latch bolt is desirable to deal with tampering as mentioned above, and particularly to thwart attempts to override or defeat the lock by an action known as "spreading". In "spreading" a pry bar or other tool is placed between the closed door and door frame and an effort is made to pry the door and door frame apart to a sufficient extent either to release the latch bolt entirely or to expose a sufficient portion of the beveled surface of the latch bolt to an attempt to manually retract said bolt. It will be appreciated that provision of additional length to the outwardly extending or latching portion of the latch bolt reduces the possibility of overriding operation of the lock or otherwise tampering with or breaking the lock by means of such "spreading".

OBJECTS OF THE INVENTION

Accordingly, it is a general object of the present invention to provide a novel and improved lock assembly.

A more specific object of the invention is to provide a lock assembly in which the latch bolt has an increased throw or effective extended length, without increasing the width dimension thereof or of the receiving strike aperture.

A related object is to provide a lock assembly in accordance with the foregoing objects which further employs a deadlock feature for preventing retraction of the latch bolt when in an extended or latched condition with the associated door in the closed condition, except upon operation of the lock assembly to an open condition by authorized means.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description of the illustrated embodiment taken in conjunction with the accompanying drawings, in the several figures of which like reference numerals identify like elements, and in which:

DETAILED DESCRIPTION OF THE ILLUSTRATED EMBODIMENT

Figure 1:
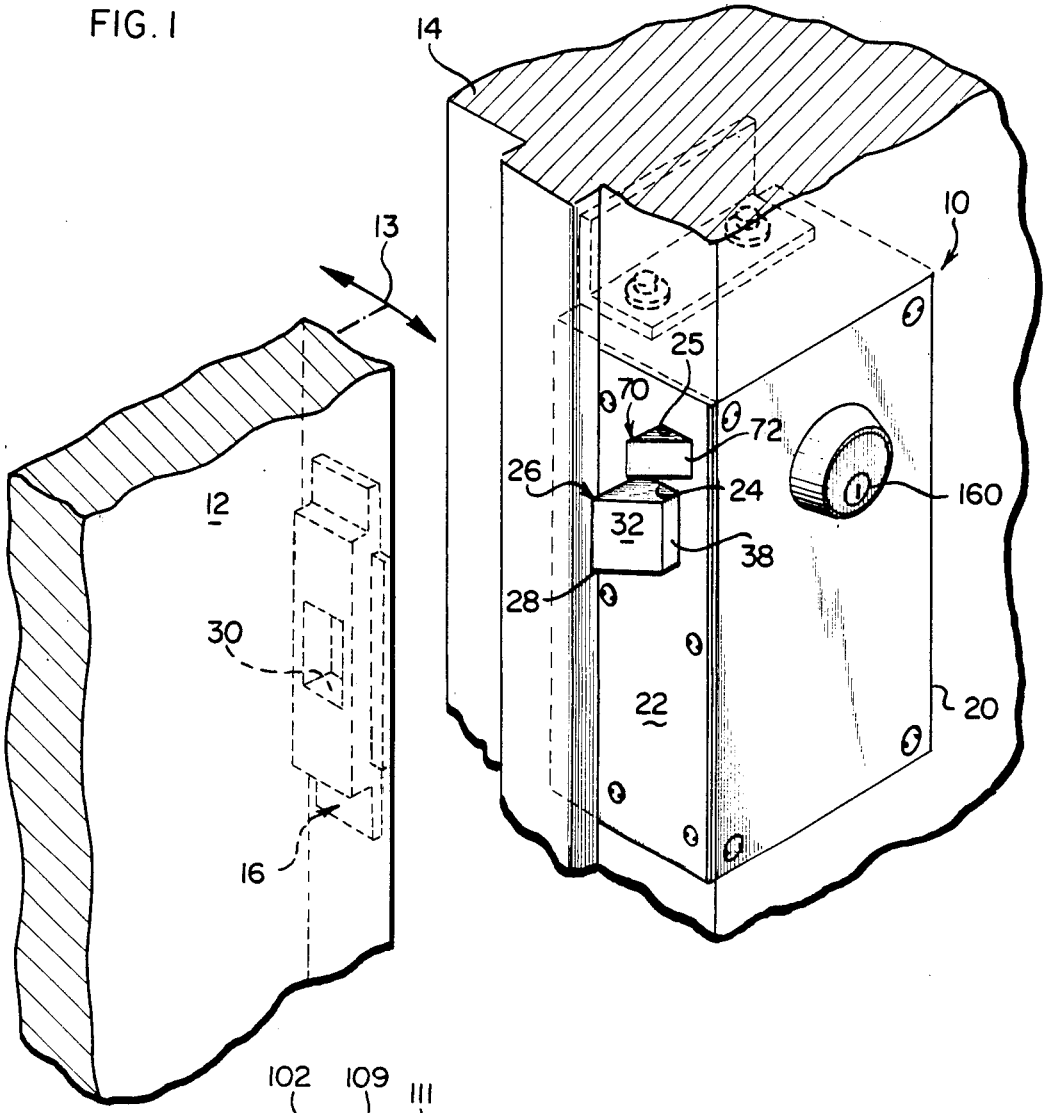
FIG. 1 is a partial perspective view, somewhat diagrammatic in form, showing a door and door frame equipped with a lock assembly in accordance with the present invention.

Referring now to the drawings and initially to FIG. 1, a lock mechanism in accordance with the present invention, designated generally by the reference numeral 10, is shown mounted in association with a door 12 and door frame 14. In the illustrated embodiment, the lock mechaism 10 is shown mounted to the door frame 14 and an associated strike plate 16 is shown mounted to the door 12. However, the lock mechanism 10 could be mounted to the door 12 and the strike plate 16 could be mounted to the frame 14 without departing from the invention. Preferably, the door 12 is a swinging door mounted for swinging movement as generally indicated by arrows 13.

However, door 12 has been moved from its normal location relative to door frame 14 in FIG. 1 to facilitate the showing of the lock mechanism 10.

The lock mechanism 10 will be seen to include a casing structure 20 which is mounted to the frame 14. This casing structure includes a face plate or front plate 22, and a pair of through apertures 24 and 25 extend through both casing 20 and front plate 22. The lock mechanism includes a latch bolt 26 retractably mounted with respect to the casing structure 20 and biased to an extended or first position as illustrated in FIG. 1. In this first or extended position a latching portion 28 of the latch bolt extends or projects outwardly of the front plate aperture 24 for engagement with a complementary aperture 30 in the strike plate 16. As will be seen later, the latch bolt 26 is movable to a second or retracted position wherein the latching portion 28 is retracted or withdrawn with respect to aperture 24.

Figure 2:
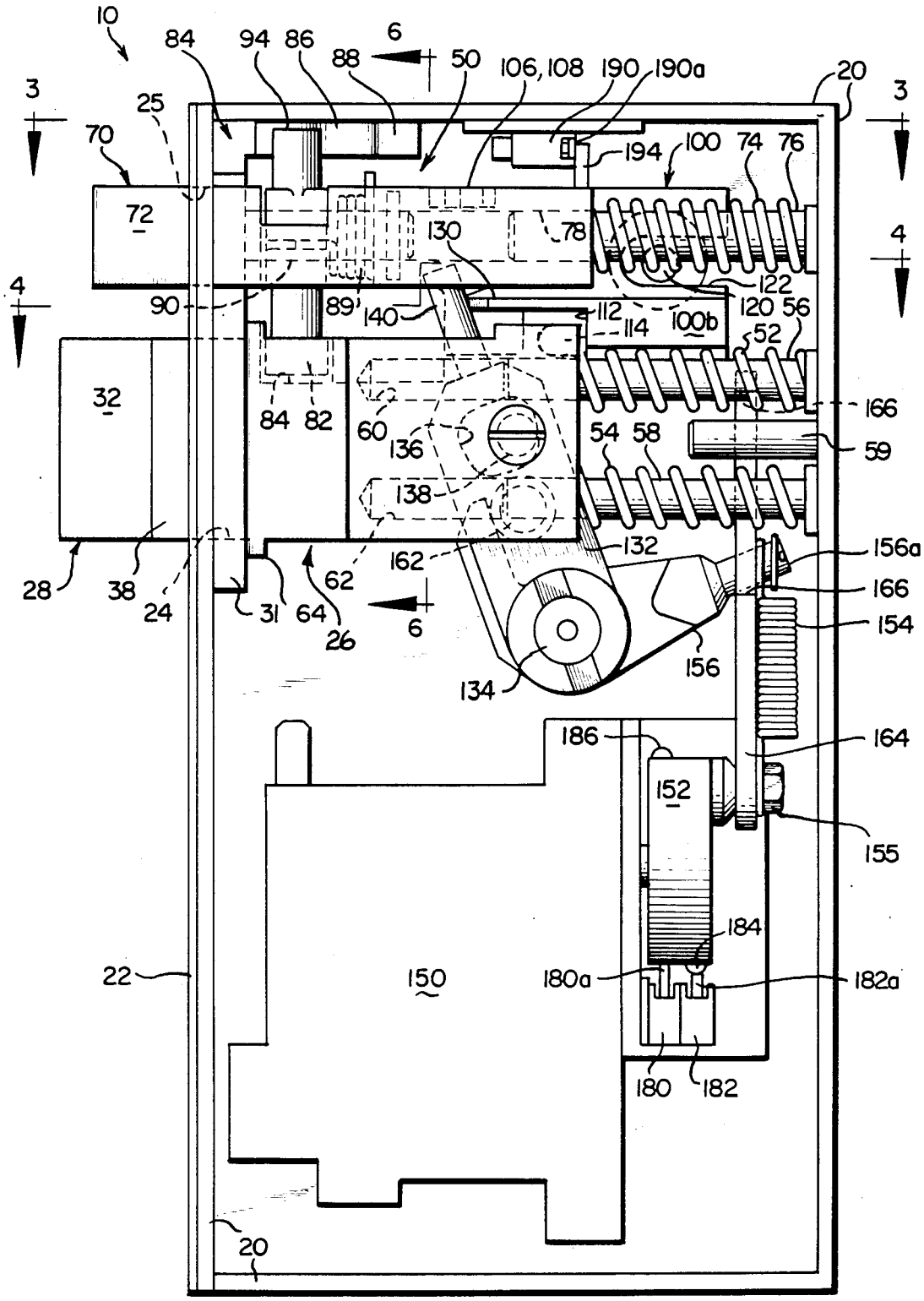
FIG. 2 is a side elevation, partially broken away, of a lock assembly in accordance with the invention, with the associated door being in an open condition.
Figure 4:
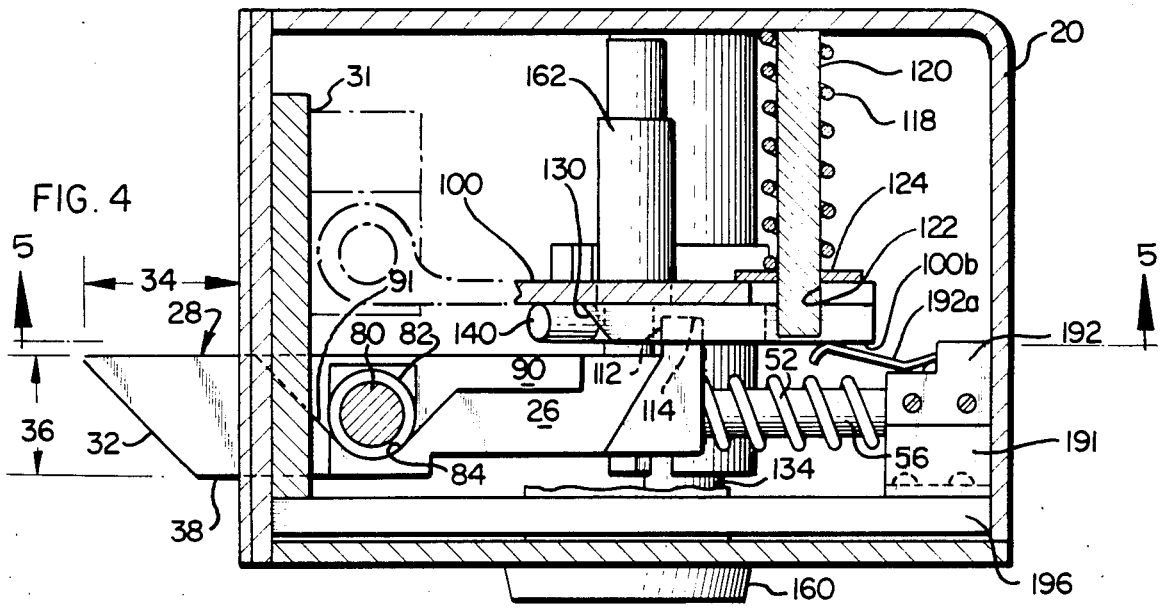
FIG. 4 is a developmental view taken generally along the line 4—4 of FIG. 2.

Referring also to FIGS. 2 and 4, the latching portion 28 of the latch bolt will be seen to have a beveled leading surface 32 proximate the distal end thereof. This surface engages an edge of the strike plate 16 as the door 12 is moved to a closed position so as to cause the outwardly biased or extended latch bolt 26 to withdraw or to retract. When the latch bolt 26 comes into alignment with the strike plate aperture 30, the latch bolt latching portion 28 will again be extended or biased outwardly into engagement with this aperture 30. In the illustrated embodiment, an additional plate 31 is added interiorly of casing 20 for added security. The through apertures 24, 25 extend through plate 31 as well.

Advantageously, the latch bolt latching portion 28 in the illustrated embodiment is of greater length dimension in the direction of its extension and retraction with respect to the front plate 22 than its thickness with respect to the thickness dimension of the associated door 12. As best viewed in FIG. 4, the length dimension of the latching portion 28 is designated by reference numeral 34 and its thickness by reference numeral 36. In order to maximize the force tending to cause retraction of the latching portion 28 upon contact with the strike plate 16, the bevel or beveled surface 32 is formed at substantially a 45-degree angle from the leading edge of the latching portion 28. Accordingly, a remaining surface, portion 38 of the latching portion 28 is not beveled and will present a surface at substantially 90 degrees to the edge of strike plate 30 when the door is swung to the closed position.

Accordingly, some predetermined amount of movement of the latch bolt 26 toward its retracted position, sufficient to withdraw or retract the surface portion 38 thereof is necessary to enable the desired engagement with the beveled surface 32 thereof with the strike plate 16. Hence, the beveled surface 32 will be located for engagement with the strike plate 16 only when the latch bolt 26 is moved a predetermined amount, comprising the length of the surface 38 thereof, toward its retracted position.

As previously indicated, it is desirable in many installations, for example security installations, to provide an additional length dimension in the fashion just described for the latching portion 28 of the latch bolt 26. However, since the width of the door 12 or the portion of door frame 14, as the case may be, for mounting the strike plate 16 is limited, an increased thickness of the latch bolt latching portion 28 normally cannot be readily accommodated. That is, since the beveled surface 32 is formed at a 45-degree angle, it would be necessary to correspondingly increase the width 36 of the latching portion 28 to assure engagement of the beveled surface 32 with the strike plate 16 during closing of the door. However, the width dimension available for the strike aperture 30 is generally limited by the width of door 12 or of the portion of frame 14 available for mounting the strike plate. Generally speaking, it is considered undesirable to increase the width of the strike aperture 30 in security installations, as this would result in a decreased dimension or thickness of material of the door 12 remaining to either side of the aperture 30. Conversely, if the strike plate 16 were mounted to frame 14 this would result in a decreased thickness of material remaining generally to the outside of the strike plate aperture 30.

Advantageously, the present invention provides an increased "throw" or length of latching portion 28 without requiring an increase of the thickness 36 thereof.

Accordingly, and referring also to FIGS. 2 through 6, additional novel retracting means or structure designated generally by the reference numeral 50 is provided for effecting the predetermined amount of movement of the latch bolt 26 toward the retracted position so as to generally withdraw or retract surface 38 and assure engagement of the beveled leading surface 32 with the strike plate upon closing of the door 12.

Referring now to FIGS. 2 through 6 it will be seen that the latch bolt 26 is normally biased to the extended position by a pair of compression springs 52, 54 surroundingly engaging respective shaft members 56 and 58, these shaft members slideably extending into complementary apertures 60, 62 formed in the body of the latch bolt 26. An additional stop member 59 may also be provided to define the fully retracted position of latch bolt 26. The fully extended position of the latch bolt 26 or of latching position 28 thereof is defined by engagement of a peripheral lip portion 64 of the latch bolt body with an inner surface of the plate 31 generally about the aperture 24 therein. Hence, it will be seen that the latch bolt is normally biased outwardly by the compression springs 52 and 54, but may readily be retracted against the spring biasing thereof if desired. Such retraction will be appreciated to be necessary to effect either engagement or disengagement between the latching portion 28 and strike aperture 30.

In accordance with a feature of the invention, the retracting means 50 will seem to include a biased trigger bolt 70 mounted to the casing structure 20 and located for engagement with the strike plate 16 prior to engagement thereof with the latch bolt 26 as the door is moved toward the closed position. In this regard, as best viewed in FIGS. 3 and 4, the trigger bolt 70 includes a substantially 45-degree beveled leading surface 72 for engagement with the strike plate 16 prior to the engagement thereof with the similar beveled surface 32 of latch bolt 26 during closing of the door.

Figure 3:
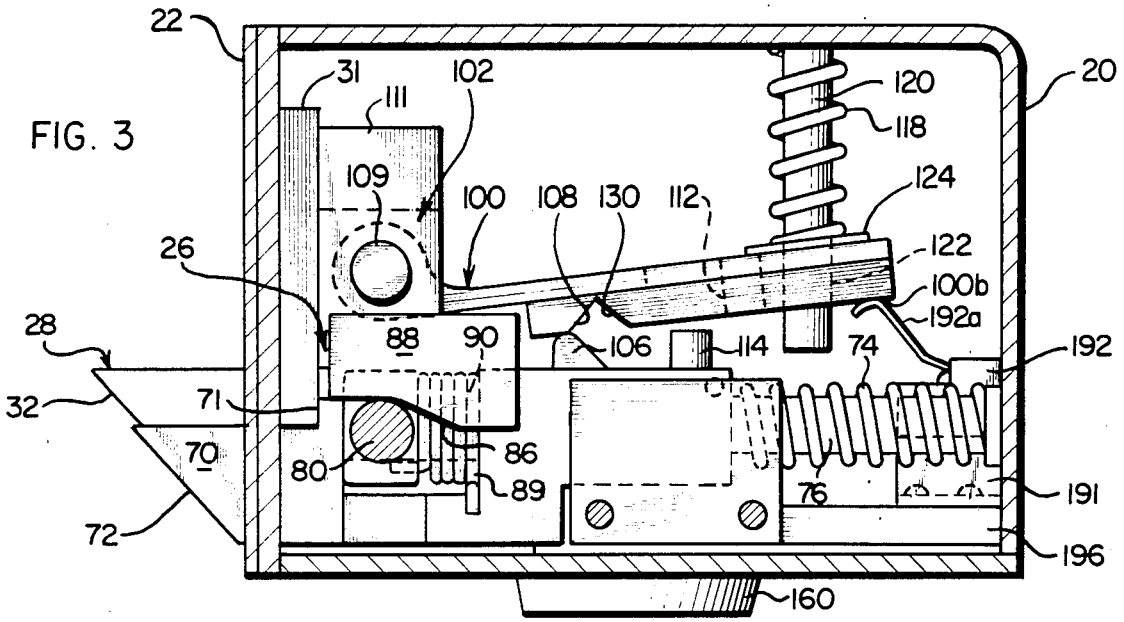
FIG. 3 is a sectional view taken generally in the plane of the line 3—3 of FIG. 2.

Moreover, the trigger bolt is also biased to an extended position with respect to the casing front plate and corresponding aperture 25, and is movable to a retracted position. In the illustrated embodiment, the retracted position of latch bolt 70 comprises the latch bolt 70 being withdrawn completely within the housing. It should also be appreciated that no aperture in strike plate 16 corresponding to strike aperture 30 is provided for the trigger bolt 70 when the door is in the closed position. In the illustrated embodiment, the biasing of the trigger bolt 70 to the extended position as shown in FIGS. 2 and 3 is accomplished by a compression spring 74 mounted about a rod or shaft 76 which slideably extends into complementary aperture 78 provided therefor in a rear portion of the body of the trigger bolt 70. A shoulder portion 71 of the trigger bolt body engages the plate 31 behind aperture 25 to limit or define the full extension of trigger bolt 70.

Further in accordance with the invention, means in the form of an elongate shaft-like member or pin 80 are provided for releasably coupling the trigger bolt 70 with the latch bolt 26 for effecting the above-described predetermined amount of movement of the latch bolt toward its retracted position in response to a like predetermined amount of movement of the trigger bolt toward its retracted position. As previously indicated, this predetermined amount of movement with respect to latch bolt 26 corresponds generally to the length of the surface portion 38 of latch bolt latching portion 28, so as to bring the beveled surface 32 thereof into engagement with the strike plate 16 as the door is closed. In this regard, it should be noted that the pin or shaft 80 is coupled to move in unison with trigger bolt 70 in a fashion which will be described presently. This pin or shaft 80 generally comprises an elongate pin or shaft-like member having a generally circular or disc-like end portion 82 thereof engaged with a complementary, generally semi-circular or U-shaped receiving slot or aperture 84 in the body of the latch bolt 26, as best viewed in FIGS. 2 and 4.

Advantageously, release means comprising cam surface 86 on a cam member 88 are provided for disengaging the releasably coupling means or pin 80 from the latch bolt 26, following the movement thereof and of trigger bolt 70 the aforementioned predetermined amount toward the retracted positions thereof. In this regard, it will be recalled that with the door in the closed condition the trigger bolt 70 is normally held in its retracted position by the strike plate 16. Accordingly, it is necessary to provide some release of the engagement between the coupling means or pin 80 and the latch bolt 26, to permit extension of the latch bolt for engagement with strike aperture 30.

In the illustrated embodiment, the pin or shaft 80 is rotatably mounted to a longitudinally running shaft member or portion 90 of the trigger bolt 70. As mentioned, the end 82 of pin or shaft 80 extends outwardly for engagement with receiving slot or aperture 84 of latch bolt 26. An oppositely extending end 94 of the pin or shaft 80 engages the cam surface 86.

The pin or shaft member 80 is also biased by resilient means in the form of a coil spring 89 toward its position illustrated in FIGS. 2 through 4, that is, for engagement of the end 82 thereof with receiving slot or aperture 84 of the latch bolt 26. However, cam surface 86 is located with respect to the pin or shaft 80, and particularly the end 94 thereof, for effecting pivotal or rotatable movement thereof in a direction for disengagement of end 82 from receiving slot 84 to ride along an elongate beveled groove or undercut formed on a facing surface of the latch bolt 26. Thereafter, further movement of latch bolt 26 toward either of the retracted or extended positions will cause end 82 to ride along one of the groove 90 or a cam surface 91 extending from the opposite side of slot 84 for disengagement of the operative connection between latch bolt 26 and pin 80. Such pivotal movement or rotation is illustrated for example in FIG. 6. Additionally, as best viewed in FIG. 3, the position of the cam 88 and its surface 86 is such that this rotation for disengagement is effected shortly following the movement of the latch bolt and of the trigger bolt respectively said predetermined amount towards the respective retracted positions thereof. This predetermined amount, as previously defined is an amount for retracting the latching portion 28 substantially the length of the surface 38 to effect positioning of beveled surface 32 for engagement with strike plate 16, as described above.

The illustrated lock mechanism further includes a deadlock member or lever 100, which is pivotally mounted to the casing as indicated at 102. This pivotal mounting permits movement of the deadlock member or lever 100 between a blocking position wherein the deadlock member will prevent retraction of the latch bolt 26, as shown for example in FIG. 4 and a non-blocking position wherein the latch bolt is free to move to the retracted position as shown for example in FIG. 3. Additional cooperating means in the form of a pair of cam surfaces 106, 108 are provided respectively on the deadlock member 100 and the trigger bolt 70 for moving the deadlock lever to the non-blocking position when the trigger bolt is in its extended position as shown in FIG. 3. In the illustrated embodiment, these cooperating means or cam surfaces comprise complementary outwardly extending cam surfaces 106 and 108 formed respectively on the trigger bolt 70 and deadlock member 100. As best viewed in FIGS. 3 and 4, when the trigger bolt 70 moves toward its retracted position, the protruding cam surface 106 travels along complementary cam surface 108 to permit the deadlock member 100 to return to the blocking position as shown in FIG. 4.

Figure 5:
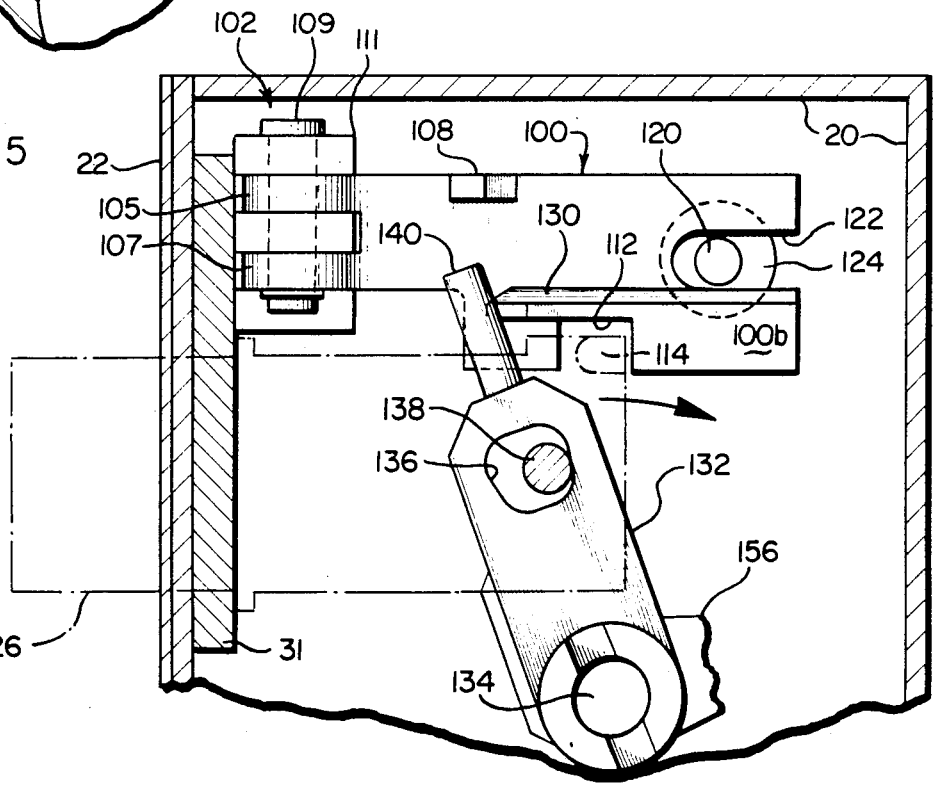
FIG. 5 is a partial sectional view taken generally in the plane of the line 5—5 of FIG. 4 and showing moved positions of some of the parts thereof.
Figure 6:
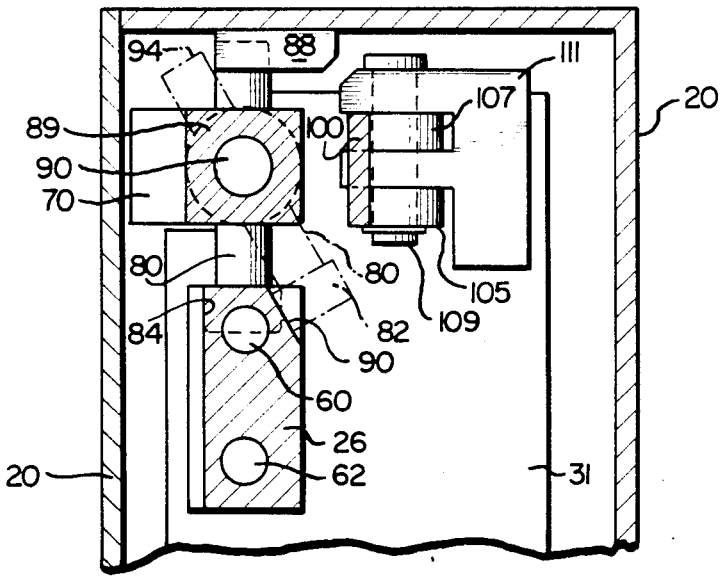
FIG. 6 is a partial sectional view taken generally in the plane of the line 6—6 of FIG. 2, and showing moved positions of some of the parts thereof.

Referring also to FIGS. 5 and 6, the deadlock member 100 will be seen to comprise an elongate lever-like or plate-like member having one end thereof pivotally mounted by a hinge like connection as indicated generally at 102. This connection is generally achieved by a pair of hinge-knuckle-like portions 105, 107 which are rotatably or pivotally mounted to a stationary shaft member 109 mounted to the casing 20 by a bracket 111.

Substantially at a mid portion thereof the deadlock member 100 has a through aperture or locking slot 112 for receiving therein a complementary locking projection 114 preferably integrally formed on the latch bolt 26. This locking aperture or slot 112 and locking projection 114, when engaged, will be seen to prevent movement of the latch bolt to the retracted position thereof.

The deadlock member 100 also includes, at a side of the aperture 112 opposite the pivotal mounting structure 102, biasing means 178, for biasing the deadlock member 100 toward its blocking engagement of the aperture 112 with the projection 114. In the illustrated embodiment, this biasing means takes the form of a compression spring 118 which is mounted in surrounding relation to a support pin or shaft 120, an outermost free end of this shaft 120 extending through a slot or aperture 122 provided therefor in the deadlock member 100. An additional spacer or washer member 124 is also provided as a bearing surface for compression spring 118 at a rear side of the deadlock member 100.

The deadlock member 100 further includes a raised surface portion **100*b* extending from or following the aperture 112, that is in the direction of retraction of the latch bolt 26 and to the side of aperture 112 opposite pivot structure 102. Engagement of the projection 114 with this raised surface 100*b* will be seen to hold the deadlock member 100 in its non-blocking position while the latch bolt is in any position intermediate the initial predetermined amount of movement thereof toward the retracted position and the fully retracted position thereof. Hence, upon disengagement of the cam surfaces 106, 108 due to initial retraction of trigger bolt 70, latch bolt 26 will be sufficiently retracted by action of pin 80 to position projection 114 for engagement with surface 100*b***.

The plate-like deadlock member 100 further includes a second cam surface 130 which leads into the raised surface portion **100*b* and begins to rise or extend from flat surface 100*a* at a point substantially immediately below the cam surface 108 as viewed in FIG. 5. This latter cam surface 130 cooperates with an operating lever 132** to effect opening and closing of the latch bolt in response to operation of an associated drive means by an authorized correctional officer or the like.

In this regard, the operating lever 132 is pivotally mounted with respect to the casing, and specifically is rotatably mounted to a shaft 134. Moreover, the operating lever is operatively coupled to the latch bolt 26 by a lost-motion type of connection, here comprising an enlarged slot or through aperture 136 in the operating lever 132 which surrounds a smaller dimension pin or projection 138 on the latch bolt 26. It will be seen that the spacing or dimension provided between the leading edge of pin 138 and facing surface of aperture 136, when the operating lever and latch bolt are in the closed position as illustrated in FIGS. 2 and 5, is such that movement of the latch bolt by the lever 132 will be delayed somewhat upon rotation or pivotal motion of the operating lever 132 about shaft 134.

The operating lever 132 further includes a projecting member or portion 140 positioned for engagement with cam surface 130 of the deadlock member 100. It will be noted that intitial rotation or pivotal motion of the deadlock lever 132 will cause this projection 140 to ride along cam surface 130 thus urging the deadlock member against the spring biasing thereof to its non-blocking position. Accordingly, the lost motion connection defined by pin 138 and aperture 136 delays movement of the latch bolt until the deadlock member is moved from the blocking position to the non-blocking position.

One or more suitable drive means for effecting pivotal movement of the operating lever 132 are also provided. In the illustrated embodiment one such drive means is provided in the form of an electrical motor 150 which is shown somewhat diagrammatically. This motor 150 rotates a cam 152 which is in turn coupled with one end of a tension spring 154. The opposite end of tension spring 154 is coupled with one end of a second lever 156 which is mounted to pivot or rotate about the same shaft 134 as operating lever 132. The lever 156 further. includes a right angle projecting portion 158 which engages a projecting pin 162 on the operating lever 132 to cause movement in the clockwise direction as viewed in FIGS. 2 and 5 of the operating lever 132 in unison with corresponding movement of the lever 156. It will be appreciated that the rotation of the motor 150 to pull tension spring 154 generally in the downwardly direction as viewed in FIG. 5 will cause such clockwise rotation or pivotal motion of lever 156 and operating lever 132 as viewed in FIGS. 2 and 5. Accordingly, operating lever 132 is free to move in the clockwise direction without operation of lever 156, for example, for operation by a key (not shown) in a cylinder lock 160 (see FIGS. 1, 3 and 4). The spring biased return of deadlock member 100 to the blocking position will also urge operating lever 132 generally to the position shown in FIGS. 2 and 5, when the latch bolt is in the extended position. This will occur due to engagement of surface 130 with projection 140.

An additional elongate link member 164 may further be provided generally in parallel alignment with tension spring 154. This elongate link member 164 is rotatably coupled with the cam 152 by the same bolt 155 as spring 154. An opposite end of elongate link 164 has an elongate slot 166 which generally surrounds a projecting portion 156*a* of lever 156 which also receives the opposite end of tension spring 154. The link 164 acts primarily as a stabilizing and alignment member for the spring 154 intermediate the cam 152 and lever 156. The elongate slot 166 will be seen to enable rotation of the motor and stretching or elongation of spring 154 without corresponding pivotal movement of levers 156 and 132 and retraction of latch bolt 26. This is provided as an anti-tampering feature, in the event some external force is applied to the latch bolt to prevent normal retraction thereof in response to operation of the motor 150. Such a feature is more fully shown and described in my co-pending application Ser. No. 614,982 filed May 29, 1984, and entitled DISC LOCK.

In the illustrated embodiment, additional monitoring means are also provided for monitoring of the condition of the lock mechanism. To this end a pair of switches 180, 182 are provided for sensing the position of the cam 152 associated with motor 150. Preferably, these switches 180 and 182 are of the momentary contact variety and each has a movable contactor 180*a*, 182*a* positioned for actuation by the cam 152 at positions thereof corresponding to the extended and retracted positions respectively of the latch bolt 26. To this end, a pair of projections 184 and 186, which here take the form of screw-type fasteners, are coupled with the cam 152, which is preferably a right cylindrical or disc-like body, at points spaced substantially 180 degrees apart thereon.

Accordingly, with the latch bolt 26 and cam 152 in the positions illustrated in FIG. 2, the movable contactor 182*a* of the switch 182 is depressed by projection 184. It will be recognized that rotation of the cam 152 substantially 180 degrees will normally result in movement or withdrawal of the latch bolt 26 to its retracted position, absent any force applied thereto preventing such movement, in response to tension spring 154 as previously discussed. In this position the projection 186 will depress the movable contactor 180*a* of switch 180.

In similar fashion, further sensor or monitoring switches 190, 192 are respectively provided for detecting the positions of the trigger bolt 70 and of the deadlock member 100. These switches 190, 192 are also preferably of the momentary contact variety having movable contactors 190*a*, 192*a* for engagement by a projecting finger 194 of the trigger bolt 70 and by deadlock member 100, respectively. Hence, with the trigger bolt 70 extended as illustrated in FIG. 2, the movable contactor 190*a* of switch 190 will be depressed by finger 194 as shown in FIG. 2. However, when the trigger bolt 70 is moved a short distance toward its retracted position, finger 194 will release the movable contactor 190*a*. The latter switch 192 is preferably mounted to a bracket 191 which is in turn mounted to a cross-member or plate 196 which also mounts the lock cylinder 160. Hence, when deadlock member 100 is in the blocking position, contactor 192*a* is depressed; however, when deadlock member 100 is in the non-blocking position, contactor 192*a* is released.

The above-described switches 180, 182, 190 and 192 may form a part of an electrical monitoring and control system of the type more fully described in my co-pending application Ser. No. 614,982, filed May 29, 1984, entitled DISC LOCK and need not be described in further detail herein. Suffice it to say that this monitoring and control system may include a control panel (not shown) at a suitable secure location for operation by security officers or the like to control operation of motor 152 and in turn control the movement of the latch bolt 26 between its retracted and extended positions.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A lock mechanism including; a casing structure adapted to be mounted to one of a door and a door frame for cooperation with an apertured strike plate mounted to the other of said door and door frame, said lock mechanism further comprising; a pair of apertures formed in said casing structure; a latch bolt retractably mounted with respect to said casing structure and biased to an extended, first position wherein a latching portion thereof extends from one of said casing apertures for engagement with said strike plate aperture, and said latch bolt being movable to a second retracted position; said latching portion of said latch bolt including a beveled leading surface located proximate the distal end of said latch bolt for engagement with said strike plate to move said latch bolt to the retracted position, and an unbeveled portion adjacent said beveled portion; a biased trigger bolt mounted to said casing structure and extending from a second one of said apertures, said trigger bolt including a camming surface and being positioned to have its camming surface engage the strike plate prior to said latch bolt, which engagement will retract said trigger bolt a predetermined amount prior to engagement of the latch bolt with said strike plate; and means operatively coupling said trigger bolt and said latch bolt such that initial retraction of the trigger bolt will effect partial and preliminary retraction of the latch bolt, which preliminary retraction of the latch bolt positions said beveled surface thereon to engage the strike plate.

2. A lock mechanism according to claim 1 wherein said latch bolt latching portion has a substantially greater length in the direction of its extension and retraction with respect to said casing aperture than its thickness with respect to the thickness dimension of the associated door, and wherein said beveled leading surface thereof comprises a substantially 45-degree beveled surface from a leading edge thereof, whereby said predetermined amount of movement toward said retracted position necessary for engagement of said beveled surface with said strike plate comprises substantially the difference between said length and said thickness of said latching portion.

3. A lock mechanism according to claim 1 and further including a deadlock member pivotally mounted to said casing for movement between a blocking position wherein said deadlock member will prevent retraction of the latch bolt and a non-blocking position wherein said latch bolt is free to move to a retracted position; and cooperating means on said deadlock member and said trigger bolt for moving the deadlock member to the non-blocking position when the trigger bolt is in its extended position.

4. A lock mechanism according to claim 3 and further including an operating lever pivotally mounted with respect to said casing and operatively coupled to said latch bolt by a lost motion type of connection, said operating lever also being engageable with said deadlock member; and drive means for effecting pivotal movement of said operating lever to retract said latch bolt, with initial pivotal movement of said operating lever resulting in the retraction of said deadlock member from the blocking position, with said lost motion connection delaying movement of said latch bolt until said deadlock member is moved from the blocking position.

5. A lock mechanism including a casing structure adapted to be mounted to one of a door and a door frame for cooperation with an apertured strike plate mounted to the other of said door and door frame, said lock mechanism further comprising; at least one aperture in said casing structure; a latch bolt retractably mounted with respect to said casing structure and biased to an extended, first position wherein a latching portion thereof extends from said casing aperture for engagement with said strike plate aperture, and movable to a second retracted position; said latching portion of said latch bolt having a beveled leading surface located for engagement with said strike plate only when said latch bolt is moved a predetermined amount toward said retracted position; and latch bolt-retracting means located for engagement with said strike plate prior to engagement thereof by said latch bolt when said door is moved toward a closed position and operatively coupled with said latch bolt for effecting said predetermined amount of movement toward said retracted position; wherein said latch bolt retracting means comprises a biased trigger bolt mounted to said casing structure and located for engagement with said strike plate prior to engagement thereof by said latch bolt when said door is moved toward a closed position, said trigger bolt being biased to an extended position from a second aperture in said casing and movable to a retracted position; means for releasably coupling said trigger bolt with said latch bolt for effecting said predetermined amount of movement of said latch bolt toward said retracted position in response to a predetermined amount of movement of said trigger bolt toward said retracted position thereof, so as to bring said beveled surface of said latch bolt into position for engagement with said strike plate; and further including a deadlock member pivotally mounted to said casing for movement between a blocking position wherein said deadlock member will prevent retraction of the latch bolt and a non-blocking position wherein said latch bolt is free to move to a retracted position; and cooperating means on said deadlock member and said trigger bolt for moving the deadlock member to the non-blocking position when the trigger bolt is in its extended position.

6. A lock mechanism including a casing structure adapted to be mounted to one of a door and a door frame for cooperation with an apertured strike plate mounted to the other of said door and door frame, said lock mechanism further comprising; at least one aperture in said casing structure; a latch bolt retractably mounted with respect to said casing structure and biased to an extended, first position wherein a latching portion thereof extends from said casing aperture for engagement with said strike plate aperture, and movable to a second retracted position; said latching portion of said latch bolt having a beveled leading surface located for engagement with said strike plate only when said latch bolt is moved a predetermined amount toward said retracted position; and latch bolt-retracting means located for engagement with said strike plate prior to engagement thereof by said latch bolt when said door is moved toward a closed position and operatively coupled with said latch bolt for effecting said predetermined amount of movement toward said retracted position; wherein said retracting means comprises a biased trigger bolt mounted to said casing structure and located for engagement with said strike plate prior to engagement thereof by said latch bolt when said door is moved toward a closed position, said trigger bolt being biased to an extended position from a second aperture in said casing and movable to a retracted position; means for releasably coupling said trigger bolt with said latch bolt for effecting said predetermined amount of movement of said latch bolt toward said retracted position in response to a predetermined amount of movement of said trigger bolt toward said retracted position thereof, so as to bring said beveled surface of said latch bolt into position for engagement with said strike plate; and further including release means for disengaging said releasably coupling means from said latch bolt following said movement thereof and of said trigger bolt respectively said predetermined amount toward said retracted positions thereof.

7. A lock mechanism including a casing structure adapted to be mounted to one of a door and a door frame for cooperation with an apertured strike plate mounted to the other of said door and door frame, said lock mechanism further comprising; at least one aperture in said casing structure; a latch bolt retractably mounted with respect to said casing structure and biased to an extended, first position wherein a latching portion thereof extends from said casing aperture for engagement with said strike plate aperture, and movable to a second, fully retracted position to permit opening and closing of the door; said latching portion of said latch bolt having a beveled leading surface located for engagement with said strike plate only when said latch bolt is moved a predetermined amount toward said retracted position; and latch bolt-retracting means located for engagement with said strike plate prior to engagement thereof by said latch bolt when said door is moved an initial amount from its open position toward a closed position; and means operatively coupling said retracting means with said latch bolt for effecting said predetermined amount of movement toward said retracted position to thereby retract said latch bolt sufficiently to position the beveled surface thereof for engagement with the strike plate to permit full retraction of said latch bolt by the strike plate upon further movement of the door toward its closed position; wherein said retracting means comprises a biased trigger bolt mounted to said casing structure and located for engagement with said strike plate prior to engagement thereof by said latch bolt when said door is moved toward a closed position, said trigger bolt being biased to an extended position from a second aperture in said casing and movable to a retracted position; means for releasably coupling said trigger bolt with said latch bolt for effecting said predetermined amount of movement of said latch bolt toward said retracted position in response to a predetermined amount of movement of said trigger bolt toward said retracted position thereof, so as to bring said beveled surface of said latch bolt into position for engagement with said strike plate.

8. A lock mechanism including a casing structure adapted to be mounted to one of a door and a door frame for cooperation with an apertured strike plate mounted to the other of said door and door frame, said lock mechanism further comprising; at least one aperture in said casing structure a latch bolt retractably mounted with respect to said casing structure and biased to an extended, first position wherein a latching portion thereof extends from a first casing aperture for engagement with said strike plate aperture, and movable to a second, fully retracted position to permit opening and closing of the door; said latching portion of said latch bolt having a beveled leading surface located for engagement with said strike plate only when said latch bolt is moved a predetermined amount toward said retracted position; and trigger bolt means located extending from a second casing aperture for engagement with said strike plate prior to engagement thereof by said latch bolt when said door is moved an initial amount from its open position toward a closed position; and means operatively coupling said trigger bolt means with said latch bolt for effecting said predetermined amount of movement toward said retracted position to thereby retract said latch bolt sufficiently to position the beveled surface thereof for engagement with the strike plate to permit full retraction of said latch bolt by the strike plate upon further movement of the door toward its closed position.

9. A lock mechanism according to claim 8 wherein said latch bolt latching portion is of substantially greater length in the direction of its extension and retraction with respect to said casing aperture than its thickness with respect to the thickness dimension of the associated door, and wherein said beveled leading surface thereof comprises a substantially 45-degree beveled surface from a leading edge thereof, whereby said predetermined amount of movement toward said retracted position necessary for engagement of said beveled surface with said strike plate comprises substantially the difference between said length and said thickness of said latching portion.

10. A lock mechanism according to claim 8 wherein said trigger bolt means comprises a trigger bolt mounted to said casing structure and biased to an extended position with respect to said second aperture in said casing and movable to a retracted position; and wherein said means operatively coupling said trigger bolt means with said latch bolt comprises means for releasably coupling said trigger bolt with said latch bolt for effecting said predetermined amount of movement of said latch bolt toward said retracted position in response to a predetermined amount of movement of said trigger bolt toward said retracted position thereof, so as to bring said beveled surface of said latch bolt into position for engagement with said strike plate.

11. A lock mechanism according to claim 10 and further including release means for disengaging said releasably coupling means from said latch bolt following said movement thereof and of said trigger bolt respectively said predetermined amount toward said retracted positions thereof.

12. A lock mechanism according to claim 11 wherein said releasably coupling means comprises an elongate member rotatably mounted with respect to said trigger bolt at a midportion thereof and having a first end for engagement with said latch bolt and a second oppositely extending end; said release means comprising a cam surface engageable with said second end of said elongate member for rotating said first end thereof away from said engagement with said latch bolt, said cam surface being located with respect to said elongate member and said trigger bolt for effecting said rotation away from engagement following said movement of said latch bolt and of said trigger bolt respectively said predetermined amount toward said retracted positions thereof.

13. A lock mechanism according to claim 12 and further including resilient means releasably biasing said elongate member for rotation in a direction for engagement with said latch bolt.

14. A lock mechanism according to claim 10 and further including a deadlock member pivotally mounted to said casing for movement between a blocking position wherein said deadlock member will prevent retraction of the latch bolt and a non-blocking position wherein said latch bolt is free to move to a retracted position; and cooperating means on said deadlock member and said trigger bolt for moving the deadlock member to the non-blocking position when the trigger bolt is in its extended position.

15. A lock mechanism according to claim 14 and further including an operating lever pivotally mounted with respect to said casing and operatively coupled to said latch bolt by a lost motion type of connection, said operating lever also being engageable with said deadlock member; and drive means for effecting pivotal movement of said operating lever to retract said latch bolt, with initial pivotal movement of said operating lever resulting in the retraction of said deadlock member from the blocking position, with said lost motion connection delaying movement of said latch bolt until said deadlock member is moved from the blocking position.

16. A lock mechanism according to claim 15 wherein said deadlock member comprises an elongate plate-like member pivotally mounted and biased for movement toward said blocking position and further including a cam surface thereon; said operating lever including a portion thereof projecting for engagement with said cam surface to effect movement of said deadlock member to the non-blocking position in response to said initial pivotal movement of said operating lever.

17. A lock mechanism according to claim 15 wherein said drive means comprises lock cylinder means coupled with said casing structure.

18. A lock mechanism according to claim 15 wherein said drive means comprises motor means operatively coupled with said operating lever.

19. A lock mechanism according to claim 14 wherein said latch bolt includes an integral projection and wherein said deadlock member includes a locking aperture engageable with said projection to effect said blocking position thereof.

20. A lock mechanism according to claim 19 wherein said deadlock member comprises an elongate plate-like member having said locking aperture at a mid portion thereof and mounted for pivotal movement with respect to said casing structure at one end thereof, and means releasably biasing said pivotally mounted plate-like member toward the blocking position for engagement of said locking aperture with said latch bolt projection; said cooperating means on said trigger bolt and on said deadlock member being further operative for releasing said deadlock member for biased movement toward its locking position in response to said predetermined amount of movement of said trigger bolt toward the retracted position thereof.

21. A lock mechanism according to claim 20 wherein said deadlock member further includes a projecting surface extending from said aperture at a side thereof opposite said pivotal mounting thereof for engagement by said latch bolt projection for holding said deadlock member in said non-blocking position following release thereof by said trigger bolt when said latch bolt is in any position intermediate said initial predetermined amount of movement thereof toward said retracted position and said retracted position.

22. A lock mechanism according to claim 20 wherein said cooperating means on said trigger bolt and said deadlock member comprise a projecting cam surface on said deadlock member and a complementary facing projecting cam surface on said trigger bolt.

23. A lock mechanism according to claim 20 wherein said means releasably biasing said elongate plate-like member comprise biasing spring means engaged with a portion thereof remote from said pivotally mounted end, said locking aperture being located intermediate the area of engagement of said spring means and said pivotally mounted end.

* * * * *